US005301582A

United States Patent [19]

Bragaglia

[11] Patent Number: 5,301,582

[45] Date of Patent: Apr. 12, 1994

[54] ROTARY CUTTER, PARTICULARLY FOR SHREDDING TOBACCO

[75] Inventor: Giorgio Bragaglia, Bologna, Italy

[73] Assignee: Comas S.p.A., Silea, Italy

[21] Appl. No.: 93,176

[22] Filed: Jul. 16, 1993

[30] Foreign Application Priority Data

Aug. 3, 1992 [IT] Italy ..... T092A000673

[51] Int. Cl.[5] ..... A24B 7/12; B26D 1/56

[52] U.S. Cl. ..... 83/338; 83/674; 83/931; 241/186.35; 241/205

[58] Field of Search ..... 83/338, 628, 632, 674, 83/931; 131/117, 118, 311, 322; 241/185.5, 186.35, 205

[56] References Cited

U.S. PATENT DOCUMENTS 3,769,867 11/1973 Schilling ..... 83/338

4,984,491 1/1991 Bragaglia ..... 83/338

FOREIGN PATENT DOCUMENTS

WO87/04905 8/1987 PCT Int'l Appl. .

*Primary Examiner*—Eugenia Jones

*Attorney, Agent, or Firm*—Edward D. Manzo

[57] ABSTRACT

A rotary cutter for cutting a block of tobacco includes a support structure having a rotatable shaft and a plurality of blade-holder carriages rotatable with the shaft. Each carriage includes a cutting blade for cutting through and penetrating a block of tobacco. Each carriage is capable of a translatory movement relative to the shaft along a line parallel to the axis of the shaft. A drive device includes plurality of rotary pinions which bring about the translatory movement of each carriage in synchronism with the rotation of the shaft during cutting the block of tobacco.

5 Claims, 4 Drawing Sheets

ROTARY CUTTER, PARTICULARLY FOR SHREDDING TOBACCO

BACKGROUND OF THE INVENTION

The present invention relates to rotary cutter, particularly for shredding tobacco, of the type comprising:

a fixed support structure, a shaft supported by the structure for rotation about an axis, at least one blade-holder carriage which can rotate with the shaft and carries at least one cutting blade for cutting through and penetrating a block of tobacco supplied in a direction such that it is inclined at an angle to the axis, the carriage being able to perform a translatory movement relative to the shaft along a line parallel to the axis, motor means for rotating the shaft, and drive means for bringing about the translatory movement of the carriage and of the associated blade in synchronism with the rotation of the shaft.

A rotary cutter of this type is described in European patent application 0 293 384.

In this known device, the drive means comprise a stationary cam with a shaped guide profile and the blade-holder carriages have respective cam followers which cooperate with the cam profile, and thrust means for urging the cam follower against the guide profile of the cam.

With this solution the magnitude and speed of the translatory movement or traverse of the blade-holder carriages which can be achieved during the fraction of each revolution in which the associated blade is cutting through the block of tobacco are quite limited.

Moreover, in the device according to the document mentioned above, all the blade-holder carriages are subjected to a translatory movement to and fro for each revolution of the shaft, with considerable stress and wear of their guides.

SUMMARY OF THE INVENTION

A first object of the present invention is therefore to provide a rotary cutter of the type indicated above which can bring about a larger translatory movement of the blades during the cutting of the block of tobacco, improving the "slicing" action achieved thereby.

This object is achieved, according to the invention, by means of a rotary cutter of the type specified above, characterized in that said drive means comprise:

a support member associated with one end of said shaft and rotatable therewith, at least one pinion carried by said support member and rotatable about an axis radial to the axis of the shaft, a stationary drive member having a toothed sector extending through an angle substantially corresponding to the angle of rotation of the shaft during which the blade of said at least one carriage can cut through the block of tobacco; said drive member being disposed adjacent said support member which is rotatable with the shaft so that the pinion can mesh with said toothed sector for each revolution of the shaft and, as a result of the meshing, can perform a rotation of a predetermined magnitude about its own axis, locking means associated with the pinion for preventing the pinion from rotating about its own axis when it is disengaged from said toothed sector, and transmission means between said pinion and the associated blade-holder carriage for bringing about a translatory movement of the carriage of a predetermined magnitude, as a result of the rotation of the pinion about its own axis.

A further object of the present invention is to provide a rotary cutter in which each individual blade-holder carriage is subjected to a translatory movement only during the fraction of each revolution of the shaft during which the associated blade is cutting through the block of tobacco, in order to reduce the stress and wear to which the guides of the carriage are subjected.

This further object is achieved, according to the invention, by virtue of the fact that said toothed sector of the drive member is conveniently arranged to rotate said pinion through 180° for each revolution of the shaft, and in that a locking member associated with the pinion has two opposed, parallel, flat, lateral surfaces which can slide alternately in contact with a flat abutment surface of the drive member.

With this solution, each blade-holder carriage is subjected to a translatory movement in one direction during a fraction of a revolution of the shaft and to a return translatory movement during a fraction of the subsequent revolution, and so on.

BRIEF DESCRIPTION OF THE DRAWINGS

Further characteristics and advantages of the invention will become clear from the following detailed description given with reference to the appended drawings, provided purely by way of non-limiting example, in which.

DETAILED DESCRIPTION OF THE INVENTION

Figure 1:
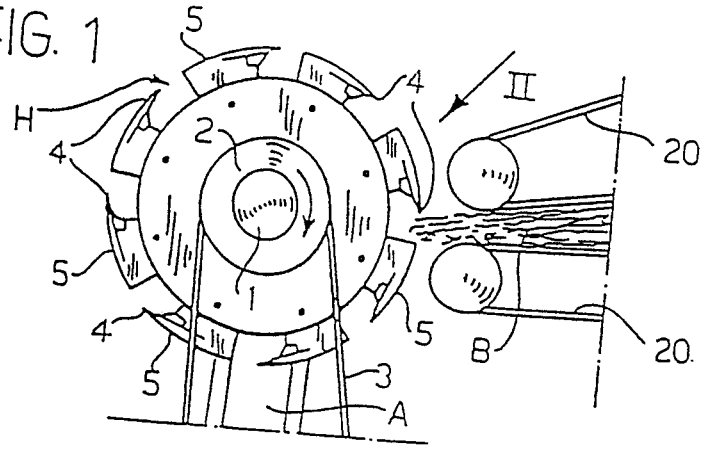
FIG. 1 is a side view of a cutter according to the invention with an associated device for supplying a block of tobacco thereto by extrusion.
Figure 2:
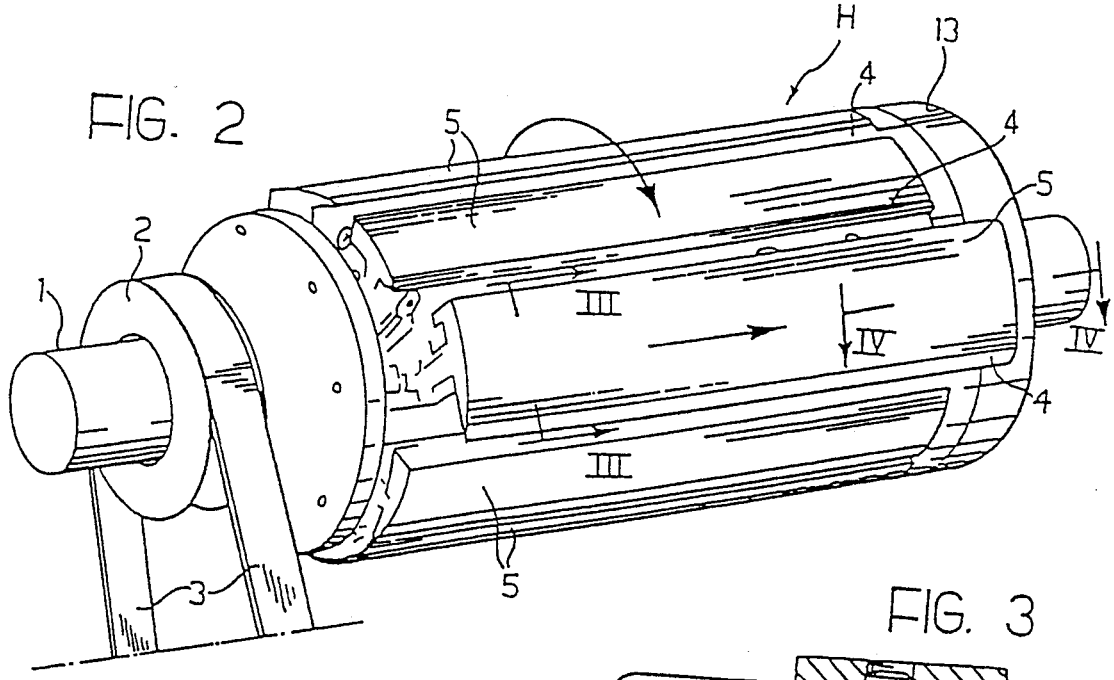
FIG. 2 is a perspective view of a cutter according to the invention.

FIGS. 1 and 2 show a rotary cutter for shredding tobacco, comprising two vertical uprights A (of which only one is visible in FIG. 1) on the upper ends of which a rotary cutting head, generally indicated H, is mounted.

The cutting head H comprises a shaft 1 supported between the uprights A so that it can rotate about a horizontal axis. A pulley 2 is keyed to one end of the shaft 1 so that it can be rotated by means of a belt.

In the embodiment illustrated, the cutting head H comprises eight cutting blades 4, each carried by a respective movable carriage 5.

Figure 3:
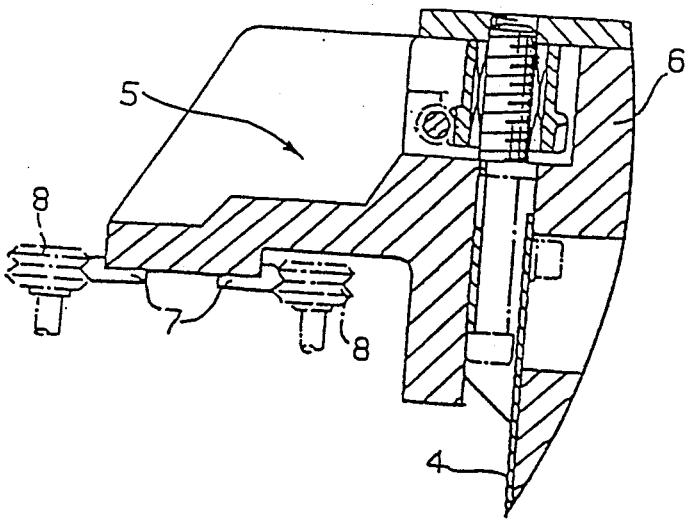
FIG. 3 is a sectioned view of a blade-holder carriage taken on the line III—III of FIG. 2.

Each carriage 5 comprises a blade-holder body 6 (FIG. 3), one side of which has a pair of parallel guides 7 with respective V-shaped profiles which engage in corresponding V-shaped grooves in a plurality of pairs of opposed rollers 8 carried by a structure fixed to the shaft 1. As described in the previous European Patent Application 0 293 384, by virtue of the coupling between the guides 7 and the guide rollers 8, the carriages 5 are fixed for rotation with the shaft 1 but can move axially relative to this shaft along lines parallel to the axis of rotation of this shaft.

Each blade-holder carriage 5 may conveniently have devices for automatically controlling the advance of the associated blade 4, for example, such as those described in the European patent application mentioned above.

The blade-holder carriages 6 are moved by means of the drive device which will now be described with particular reference to FIGS. 2 and 4 to 7.

Figure 4:
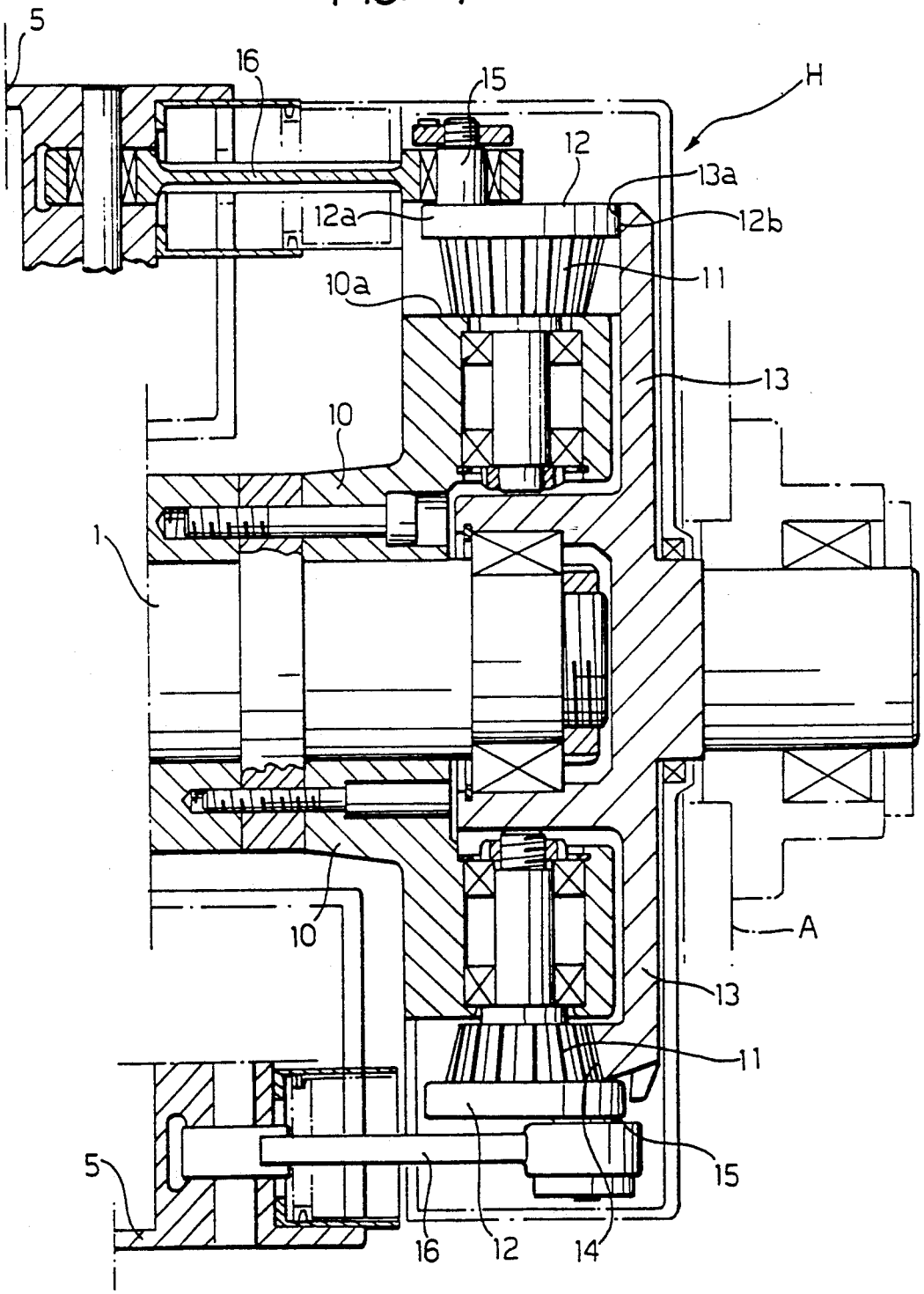
FIG. 4 is a sectioned view taken on the line IV—IV of FIG. 2, on an enlarged scale.
Figure 5:
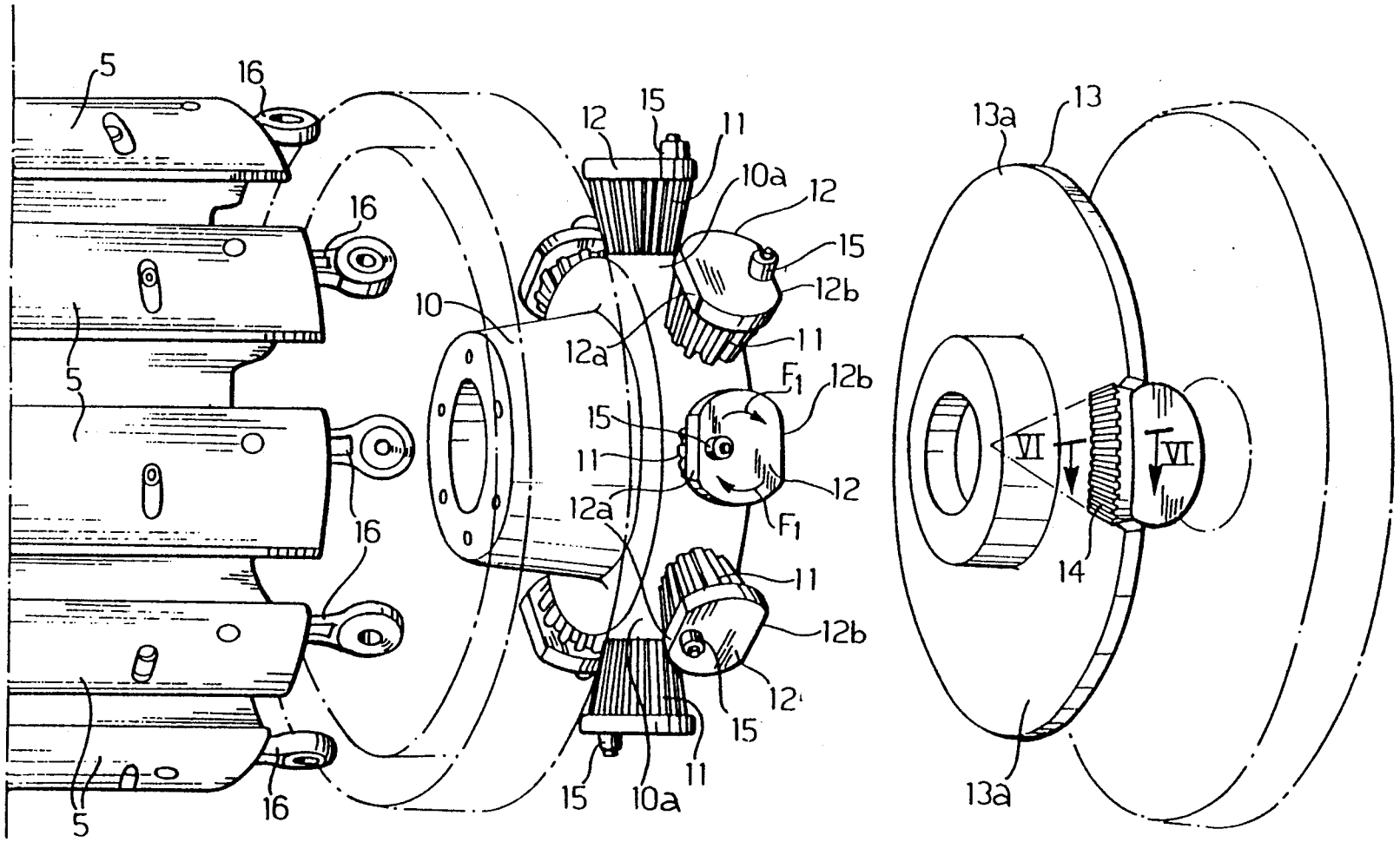
FIG. 5 is an exploded perspective view of a portion of the cutter according to the invention.
Figure 6:
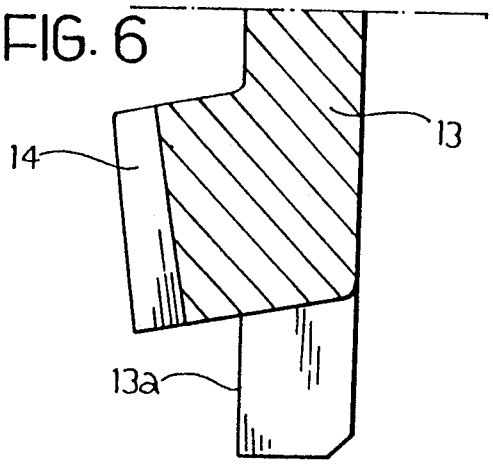
FIG. 6 is a sectioned view taken on the line VI—VI of FIG. 5.

A substantially bell-like support member, indicated 10 in FIGS. 4 and 5, is fixed to one end of the rotary shaft 1 (the right-hand end as seen in FIG. 2).

This member is therefore rotatable together with said shaft. A plurality of equiangularly-spaced, conical pinions 11 is mounted on the periphery of the end portion 10*a* of this member and each is associated with a respective blade-holder carriage 5. The axes of the pinions are oriented radially relative to the shaft 1 and the pinions can rotate about their own axes as indicated by the arrows F1 in FIG. 5.

As stated above, the pinions 11 are substantially frustoconical and respective locking members, indicated 12, are connected to their larger bases which face radially outwardly. Each locking member can rotate about the axis of the pinion 11 together with the associated pinion and, in the embodiment illustrated, its lateral surface has two opposed, parallel, flat faces indicated 12*a* and 12*b*.

A substantially disc-shaped drive member, generally indicated 13 in FIGS. 2 and 4 to 7, is fixed in a stationary position facing the drive member 10.

The drive member 13 has a toothed sector 14 (FIGS. 4 to 7) which extends through an angle corresponding substantially to the angle of rotation of the shaft 1 for which each blade 4 can cut through the block or cake of tobacco. With reference to FIG. 1, in which the block of tobacco B is supplied to the cutting head H by means of a belt extruder 20, it can be seen that the angle of rotation of the shaft for which each blade penetrates said block represents only a small fraction of a turn or revolution of the shaft. This angle may be, for example, of the order of 30°.

As can better be seen in FIG. 4, the arrangement of the member 10, the associated pinions 11, and the drive member 13 is such that, as a result of a rotation of the shaft 1, each pinion 11 can mesh with the toothed sector 14 once for each revolution of the shaft. As a result of this meshing, each pinion performs a rotation of a predetermined magnitude, conveniently 180°, about its own axis. When a pinion 11 is meshed with the toothed sector 14, all the other pinions are prevented from rotating about their axes since flat faces 12*a* or 12*b* of the respective locking members 12 associated therewith are sliding over a corresponding flat surface 13*a* of the drive member 13.

Figure 7:
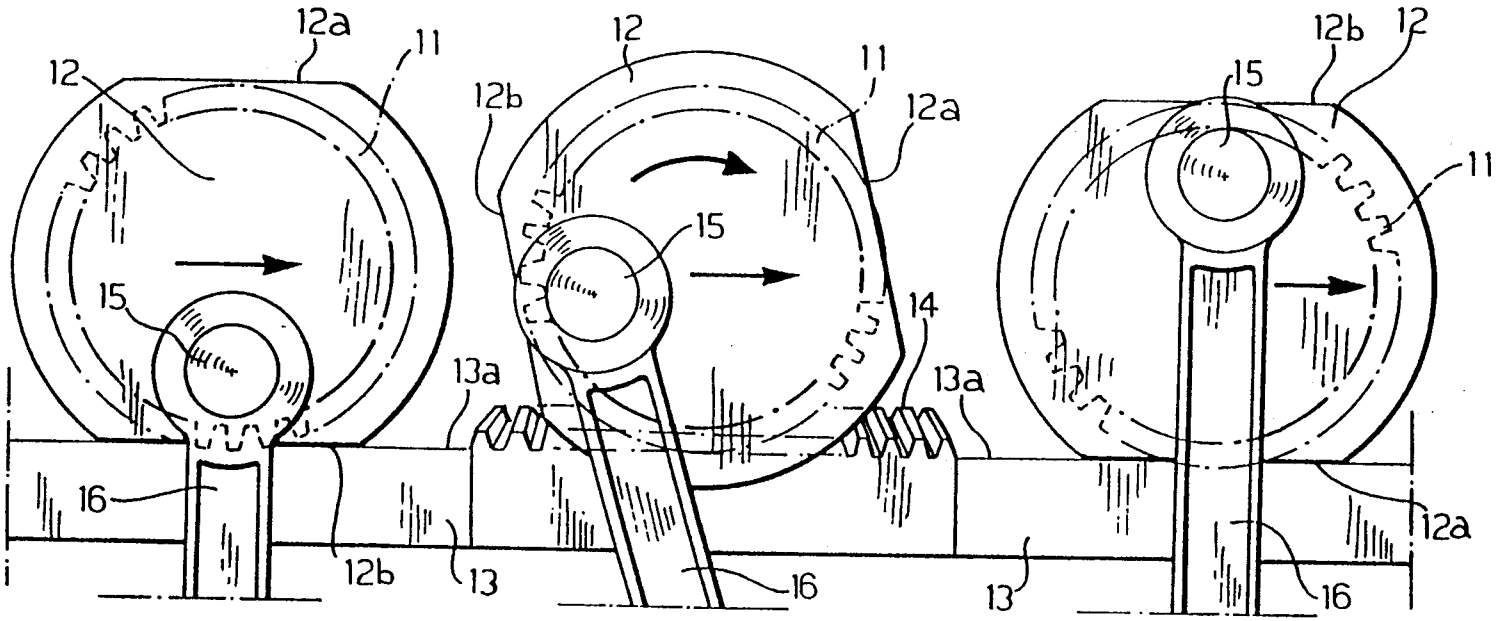
FIG. 7 shows three successive positions assumed by a portion of the cutter according to the invention in operation.

As is clear from FIGS. 4, 5 and 7, each locking member 12 carries a respective eccentric pin or projection 15 which acts as a crank pin on which a first end of an associated connecting rod 16 is articulated, its other end being articulated to one end of a corresponding blade-holder carriage 5.

In operation, the meshing of a pinion 11 with the stationary toothed sector 14 causes the pinion to rotate through 180° and—by means of the associated connecting rod 16—causes a translatory movement of the corresponding blade-holder carriage 5 parallel to the axis of the rotary shaft 1.

The toothed sector 14 of the stationary drive member 13 is positioned in a manner such that the translatory movement performed by each blade-holder carriage 5 for each revolution of the shaft takes place whilst the associated blade is passing through the block of tobacco B. An effective "slicing" cut is thus achieved with optimal quality of the shredding of the tobacco.

As a result of the sequential meshing of the pinions 11 with the stationary toothed sector 14, each blade-holder carriage performs a single outward or return traverse for each revolution of the shaft 1 and, for the subsequent revolution, it correspondingly performs a return or outward traverse, moving in the opposite direction from that followed during the preceding revolution.

Each blade-holder carriage thus performs one complete outward and return traverse for each two revolutions of the shaft, which greatly reduces the stress and wear to which the guide means associated with said carriages are subjected.

The magnitude of the translatory movement performed by each blade-holder carriage for each revolution may be determined at will by the dimensioning of the crank mechanism which converts the rotation of the pinions 11 into translatory movements of the corresponding blade-holder carriages. In particular, it is possible to achieve considerably larger translatory movements of these carriages than it was previously possible by means of translatory drive systems with cams.

Naturally, the principle of the invention remaining the same, the forms of embodiment and details of construction may be varied widely with respect to those described and illustrated purely by way of non-limiting example, without thereby departing from the scope of the present invention.

What is claimed is:

1. A rotary cutter, particularly for shredding tobacco, comprising:

a fixed support structure, a shaft supported by said structure for rotation about an axis, at least one blade-holder carriage rotatable with the shaft and capable of performing a translatory movement relative to the shaft along a line parallel to the axis of the shaft, at least one cutting blade carried by the carriage for cutting through and penetrating a block of tobacco supplied in a direction such that the block of tobacco is inclined at an angle to the said axis, motor means for rotating said shaft, and drive means for bringing about the translatory movement of the carriage and of the associated blade during the cutting of the block of tobacco, in synchronism with the rotation of the shaft;

wherein said drive means comprise:

a support member associated with one end of said shaft and rotatable with the shaft, at least one pinion carried by said support member and rotatable about an axis radially spaced with respect to the axis of the shaft, a stationary drive member having a toothed sector extending through an angle substantially corresponding to the angle of rotation of the shaft during which the blade of said at least one carriage can cut through the block of tobacco, said drive member being disposed adjacent to said support member so that the pinion meshes with said toothed sector for each revolution of the shaft and, as a result of the meshing, said pinion performs a rotation of a predetermined magnitude about its own axis, locking means associated with the pinion for preventing the pinion from rotating about its own axis when the pinion is disengaged from said toothed sector, and transmission means between said pinion and the associated blade-holder carriage for bringing about a translatory movement of a predetermined magnitude as a result of the rotation of said pinion about its own axis.

2. A cutter according to claim 1, wherein said locking means comprise a locking member rotatable about said radially spaced axis with the associated pinion, the locking member having at least one flat lateral surface and the drive member having a corresponding flat abutment surface in slidable contact with the at least one flat surface of the locking member when the pinion is disengaged from the toothed sector of said drive member.

3. A cutter according to claim 2, wherein said toothed sector of the drive member is arranged to rotate said pinion through 180° for each revolution of the shaft, and the locking member has two opposed, parallel, flat lateral surfaces which are alternately in slidable contact with the flat abutment surface of the drive member.

4. A cutter according to claim 1, wherein said locking means comprises a locking member fixed to the pinion and said transmission means comprise a mechanism including a connecting rod having one end articulated to the blade-holder carriage and a crank pin to which the other end of the connecting rod is articulated, the crank pin being carried in an eccentric position by the pinion and the locking member fixed to the pinion.

5. A cutter according to claim 1, wherein the at least one blade-holder carriage comprises a plurality of blade-holder carriages rotatable with the shaft and movable axially relative thereto, and the at least one pinion comprises a plurality of radial pinions rotatable about respective radially spaced axes and meshing with the toothed sector of said drive member in succession.

* * * * *